US006308542B1

(12) United States Patent
Bolton

(10) Patent No.: US 6,308,542 B1
(45) Date of Patent: Oct. 30, 2001

(54) KEY ASSEMBLIES AND METHODS OF MAKING SAME

(75) Inventor: Brian L. Bolton, Kirksville, MO (US)

(73) Assignee: Ortech Co., Kirksville, MO (US)

( * ) Notice: Subject to any disclaimer, the term of this patent is extended or adjusted under 35 U.S.C. 154(b) by 0 days.

(21) Appl. No.: 08/948,180

(22) Filed: Oct. 9, 1997

Related U.S. Application Data

(60) Provisional application No. 60/028,308, filed on Oct. 11, 1996, and provisional application No. 60/048,545, filed on Jun. 3, 1997.

(51) Int. Cl.[7] ..... E05B 19/04

(52) U.S. Cl. ..... 70/408; 70/460; 70/278.3; 340/805.31

(58) Field of Search ..... 70/408, 395, 278, 70/460, 397, 278.2, 278.3; 340/805.31

(56) References Cited

U.S. PATENT DOCUMENTS

| | | | | |
|---|---|---|---|---|
| 3,313,135 | * | 4/1967 | Reisner | 70/408 |
| 3,883,629 | * | 5/1975 | Garner et al. . | |
| 4,200,227 | * | 4/1980 | Lemelson | 70/408 |
| 4,389,063 | * | 6/1983 | Ryan . | |
| 4,768,362 | * | 9/1988 | Schmalz, Jr. | 70/408 |
| 4,922,736 | * | 5/1990 | Tanaka et al. | 70/408 |
| 4,998,952 | * | 3/1991 | Hyatt, Jr. et al. | 70/408 |
| 5,311,757 | * | 5/1994 | Spahn | 70/408 |
| 5,337,588 | * | 8/1994 | Chhatwal | 70/278 |
| 5,433,096 | * | 7/1995 | Janssen et al. | 70/413 |
| 5,632,168 | * | 5/1997 | Yano | 70/413 |
| 5,727,408 | * | 3/1998 | Mizuno et al. | 70/413 |
| 5,732,579 | * | 3/1998 | D'Hont et al. | 70/413 |
| 5,768,925 | * | 6/1998 | Ozawa et al. | 70/408 |
| 5,775,148 | * | 7/1998 | Layton et al. | 70/408 |
| 5,819,564 | * | 10/1998 | Watanuki | 70/408 |
| 5,819,568 | * | 10/1998 | Christie et al. | 70/413 |

FOREIGN PATENT DOCUMENTS

| | | | |
|---|---|---|---|
| 0401541 | * | 12/1990 | (EP) . |
| 648589 | * | 4/1995 | (EP) . |
| 2039321 | * | 8/1990 | (GB) . |
| 3-279572 | * | 12/1991 | (JP) . |
| 9005821 | * | 5/1990 | (WO) . |
| 9427422 | * | 12/1994 | (WO) . |

* cited by examiner

*Primary Examiner*—Darnell Boucher
(74) *Attorney, Agent, or Firm*—D. D. McGraw

(57) ABSTRACT

Key assemblies each having a key blank, a transponder, a transponder holder and a key head section cover molded to encapsulate the transponder and at least part of its holder. A logo may be provided on one or both sides of the key head section cover, or on a transponder holder which is molded about a part of the key head section. In one embodiment, the transponder holder is premolded, after which the transponder is inserted in it and resiliently held in place by resilient parts of the holder. The transponder and holder subassembly is then slid into a generally U-shaped key head with the legs defining the sides of that key head sliding in open channels formed by legs of the holder which are moved against the resilience of the cantilever mounting of the legs to the transponder mounting section of the holder. The holder legs are latched in a snap-fitting action by protrusions which cam the holder legs toward the transponder mounting section of the holder, then snap into openings in the bottoms of the open channels to precisely locate and hold the transponder holder and the transponder in place in the key head section. The disclosure includes the elements and the method of making the complete key assembly. As an alternative, the transponder holder is made by molding it to the key head section legs while forming a recess in it to hold the transponder. The transponder is then inserted in the recess and a plug closes the open end of the recess to hold the transponder in place.

5 Claims, 5 Drawing Sheets

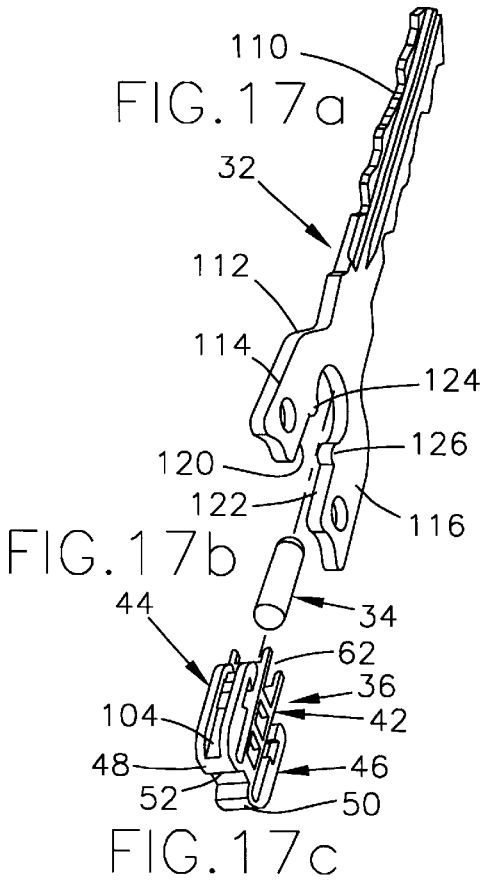
FIG.17a
FIG.17b
FIG.17c
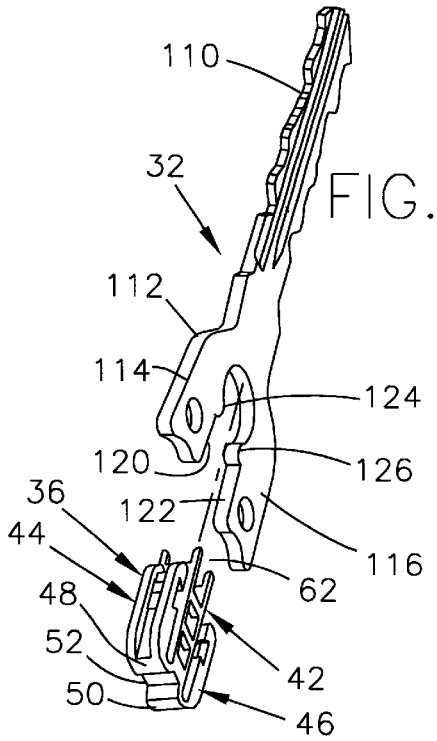
FIG.18b
FIG.18a
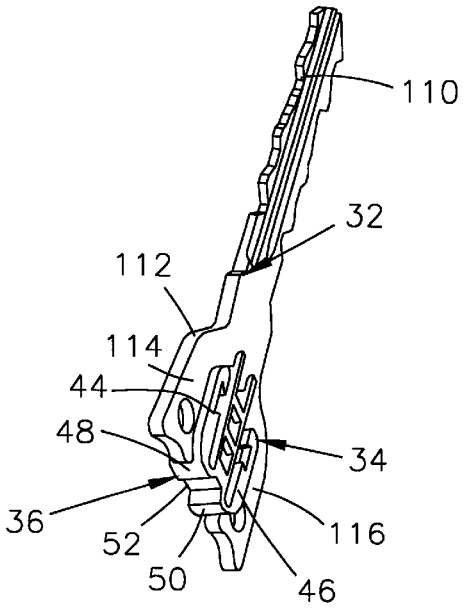
FIG.19
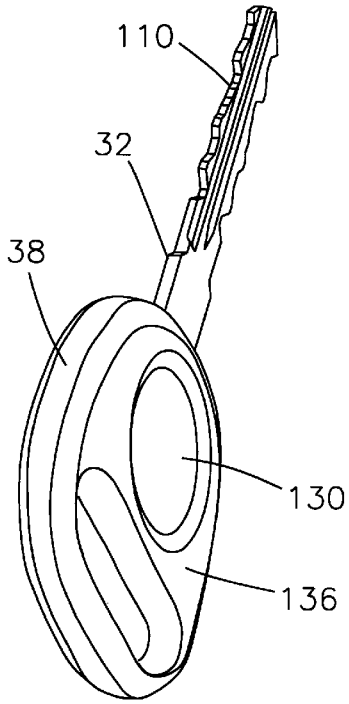
FIG.20

KEY ASSEMBLIES AND METHODS OF MAKING SAME

CLAIM OF PRIORITY AND BENEFIT OF EARLIER FILING DATES

The inventor of this United States Patent Application filed under 35 U.S.C. 111(a) hereby claims priority of invention and the benefit of earlier filing dates in the United States under 35 U.S.C. 119(e) and 35 U.S.C. 120 for the invention disclosed herein in the manner provided by the first paragraph of 35 U.S.C. 112, that claim of priority and benefit of earlier filing dates being based on the disclosures of U.S. Provisional Applications Ser. No. 60/028,308 filed Oct. 11, 1996, and Ser. No. 60/048,545 filed Jun. 3, 1997, by the applicant Brian L. Bolton, Kirksville, Mo., who is the inventor named in this United States Patent Application as the inventor of the invention herein disclosed and claimed. The above-identified Provisional Applications fully comply with 35 U.S.C. 119(e)(2).

FIELD OF THE INVENTION

The invention relates to a key assembly containing an electronic transponder mounted therein, and to methods of making the key assembly. The transponder may be employed for theft deterrence and for control of various circuits in a mechanism in which the key assembly may be selectively inserted and removed.

BACKGROUND OF THE INVENTION

In recent years, it has become common to provide key assemblies which have devices therein which either generate a coded signal or are sensitive to an outside code reading mechanism which reads the code contained in each key assembly's device. One such device may be an electronic transponder. A common use in recent years has been in a motor vehicle ignition key and lock arrangement.

When the key assembly is inserted in its receiving mechanism, such as an ignition key lock, the code embedded in or emitted by the transponder of the key assembly is matched with a corresponding code detector to permit the key to unlock the lock so that the vehicle engine ignition system may be actuated. Actuation of the key may also unlock a steering shaft lock which has prevented the steering wheel from being moved, and it may unlock a lock installed in an electrical circuit or a door or the like which is locked.

Should a key assembly which does not provide a proper code signal be inserted in the lock, the code detector may actuate any controlled unlocked locks. It may actuate a theft warning device, interior and/or exterior lights, and render a starter mechanism inoperative, by way of example.

Numerous patents have been issued on this general subject, the more pertinent ones known to the inventor of the invention claimed herein showing conventional transponder key assemblies being the U.S. Pat. No. 5,433,096—Janssen et al (1995) and U.S. Pat. No. 5,632,168—Yano (1997). The list below includes these patents and less pertinent patents and publications disclosing conventional transponder key assemblies or other broadly related arrangements being the following, listed in patent number order in the case of the U.S. patents:

U.S. Pat. No. 4,200,227—Lemelson (1980); U.S. Pat. No. 4,257,030—Bruhin et al (1981); U.S. Pat. No. 4,287,735—Brunken et al (1981); U.S. Pat. No. 4,663,952—Gelhard (1987); U.S. Pat. No. 4,858,453—Namazue (1989); U.S. Pat. No. 4,922,736—Tanaka et al (1990); U.S. Pat. No. 4,924,686—Vonlanthen (1990); U.S. Pat. No. 4,947,662—Imedio (1990); U.S. Pat. No. 5,003,801—Stinar et al (1991); U.S. Pat. No. 5,038,590—Sawyer (U.S. Pat. No. 5,083,362—Edgar et al (1992); U.S. Pat. No. 5,156,032—Edgar (1992); U.S. Pat. No. 5,195,341—Nieuwkoop (1993); U.S. Pat. No. 5,307,658—Kokubu et al (1994); U.S. Pat. No. 5,311,757—Spahn (1994); U.S. Pat. No. 5,337,588—Chhatwal (1994); U.S. Pat. No. 5,433,096—Janssen et al (1995); U.S. Pat. No. 5,461,386—Knebelkamp (1995); U.S. Pat. No. 5,469,727—Spahn et al (1995); U.S. Pat. No. 5,532,522—Dietz et al (1996); U.S. Pat. No. 5,561,420—Kleefeldt et al (1996); U.S. Pat. No. 5,561,430—Knebelkamp (1996); and U.S. Pat. No. 5,632,168—Yano (1997).

Also, PCT International Publication No. WO 87/00234 published Jan. 15, 1987; European Patent Office published summary of a German-language application filed Jun. 26, 1991, claiming priority as of Dec. 22, 1989, and identified as Veröffentichungsnummer: 0 434 176 A1; Japanese Patent Application Publication Nos. 2-164647 (1990) and 4-11179 (1992); and UK Patent Application GB 2 155 988 A published on Oct. 2, 1985.

SUMMARY OF THE INVENTION

A key assembly embodying one aspect of the invention includes a key blank having a particular construction on one end in which a transponder and a transponder holder are mounted, and a key head cover molded over the portion of the key blank in which the transponder and its holder are mounted. The key blank has a head section and a shank section, with a portion connecting those two sections. While various key shank sections may be employed, their precise construction is not a part of this invention. Therefore, the invention is shown with a simple shank section connected to the head section and having a simple key profile. It is to be understood that other known key shank section shapes, both in cross section and in profile, may be employed in a key assembly embodying the invention. The shank section of the illustrative key therefore includes that part of the key typically having a profile which cooperates with the mechanical portion of the lock to release the locking mechanism when the key shank profile mates with the lock profile and the key is rotated. Such key shank sections, once cut to a specific profile, are used in most cylindrical locks of the type commonly used in automotive vehicle doors and ignition systems, as well as many keys fitting locks for doors in buildings.

More particularly relating to the invention, the head end of the key blank is shaped to provide a pair of legs defining, with the inner axial end of the key shank, a generally U-shaped recess configuration with the open end of the recess extending in an opposite axial direction on the key blank from the shank end of the key. The transponder holder is snap-fitted within the U-shaped recess after the transponder has been fitted within the transponder holder and is resiliently supported within that holder. The portions of the transponder holder which are engaged with the key blank legs also are resiliently connected to the portion of the transponder holder which resiliently supports the transponder.

The key blank legs are preferably provided with protrusions which mate with corresponding depressions or openings formed in the transponder holder so that the snap-fitted action of the transponder holder in relation to the legs occurs when the transponder holder is inserted into position between the key blank legs until the protrusions mate with their corresponding openings.

It is another feature of the invention that the transponder holder depressions or openings are within the bottom portions of channels defined along the edges of the transponder holder, with the laterally inwardly extending edges of the key blank legs being received in sliding relation in said channels as the transponder holder is moved into its snap-fitted position within the U-shaped recess. The side portions of the channels engage the sides of portions of the key blank legs and minimize any movement of the holder in any direction which is substantially perpendicular to the direction of sliding movement assembly of the transponder holder to the legs of the key blank. This is particularly important from the time that the transponder and its holder are inserted in place in the key blank until the key head cover is molded about the key head and the transponder and its holder, permanently securing them in place in relation to the key head.

Another feature of the invention is provided wherein the transponder holder is fabricated of a suitable plastic material which is sufficiently stiff at its channels and at its transponder mounting section to hold the transponder in a precisely defined position in the key blank while also having resilient sections which provide a resilient mounting arrangement between the transponder and its mounting section and also provides a resilient mounting arrangement between the transponder mounting section and its channels. It is particularly desirable, and is a feature of the invention that is preferably used, wherein the transponder mounting section of the transponder holder is resiliently supported in cantilever spring fashion by the transponder holder legs and their spring connections to the transponder mounting section. This resilient support is particularly advantageous when the transponder and its holder are assembled together and handled as a subassembly before being installed into the key blank head section having the U-shaped recess, as well as the subassembly of the transponder, transponder holder and the key blank before the key head in molded in place.

Another feature of the invention resides in the molding of the key head cover over the key head end, including legs and the end of the key shank forming the bottom of the U-shaped recess, and over the transponder holder and the transponder within it, securing them in position in the key head.

In another aspect of the invention, the transponder holder is molded in place between and over portions of the key head, including the key blank legs, creating a first subassembly. The transponder and a transponder retaining plug are then inserted into the molded transponder holder, forming a second subassembly including the molded transponder holder and the key blank. The key head cover is then molded in place over portions or all of the transponder holder and the key head, providing a key chain slot and sealing the transponder and its plug in place.

In one variation of this aspect of the invention, during the molding operation of the transponder holder, a suitable logo is integrally molded on its side surfaces. Then, when the key head cover is molded over only portions of the transponder holder, leaving an opening over each logo. The side surfaces of the holder constituting the logo remain uncovered and the logo remains visible even though the material from which the key head cover is molded is opaque. When the material from which the key head cover is transparent upon completion of its molding process and the key head cover is molded over the entire transponder holder, or when the key head cover is molded with one or more transparent windows corresponding to the one or more logos molded on the transponder holder side surfaces, those logos will remain visible through those transparent windows.

In another variation, the key head cover is molded with externally facing recesses on its side surfaces, and discs with logos thereon are secured in those recesses. This permits the logos to be installed at a later time, well after the date of manufacture of the key assembly, if desired.

The manner of assembling the various parts of each of the various key assemblies embodying the invention into an integrated whole is also a feature of the invention, as well as the process of making of the key assemblies.

BRIEF DESCRIPTION OF THE DRAWINGS

FIG. 17*a* is an isometric view of the key blank shown in FIGS. 14–15, positioned to illustrate, with FIGS. 17*b* and 17*c*, a step in the process of making the key assembly of FIGS. 1–5 by assembling the parts in the order described.

FIG. 17*b* an isometric view of the transponder also shown as a part of the subassemblies of FIGS. 11–13 and 16.

FIG. 17*c* is an isometric view of the transponder holder of FIGS. 6–10 and also shown as a part of the subassemblies of FIGS. 11–13 and 16.

FIG. 18*a* is identical to FIG. 17*a*, and is also an isometric view of the key blank shown in FIGS. 14–15, positioned to illustrate, with FIG. 18*b,* another step in the process of making the key assembly of FIGS. 1–5 by assembling the parts in the order described.

FIG. 18*b* is an isometric view of the subassembly of FIGS. 11 and 12 after the step of forming that subassembly has been taken. It is positioned in relation to the key blank of FIG. 18*a* to show the relationship between the subassembly and the key blank immediately before the next assembly step is taken.

FIG. 19 is an isometric view of the subassembly of FIGS. 13 and 16 when the step of inserting the subassembly of FIG. 18*b* into the space provided in the key blank of FIG. 18*a* has been completed.

FIG. 20 is an isometric view of the key assembly of FIGS. 1–5 after the step of molding the key head cover in place has been completed.

FIG. 24 is an isometric view of the subassembly of the elements of FIG. 23 after the elements have been inserted into the transponder holder of the subassembly of.

DETAILED DESCRIPTION OF THE EMBODIMENTS OF THE INVENTION

Figure 1:
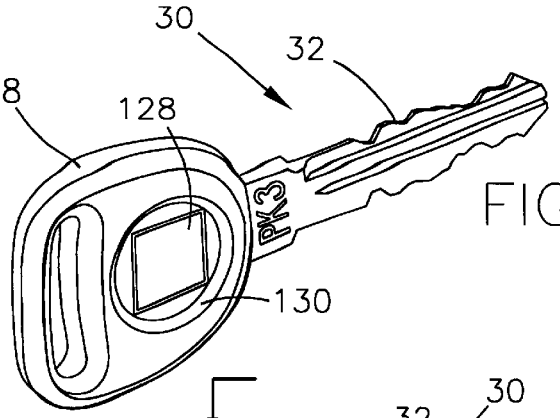
FIG. 1 is an isometric view of a key assembly embodying the invention.

The following description relates to the disclosures in FIGS. 1 through 20. The key assembly 30 includes a key blank 32, a transponder 34, a transponder holder 36, and a key head cover 38. The transponder 34 is illustrated as being shaped much like a medical capsule in that it has a cylindrical body and rounded ends.

The specific construction of the holder 36 is that of a holder body 40 (having the transponder 34 held therein) comprising a transponder-mount section 42 and legs 44 and 46, legs 44 and 46 respectively having a reversely-bent spring section 48, 50 attached to one end 52 of the transponder mount section 42. The legs 44 and 46 extend in substantially parallel spaced relation to and on opposite sides 54 and 58 of the mount section 42.

The transponder mount section 42 is an open-framed cage construction defining a transponder retention space having an opening 62 at its open end 64 and a closed end 66 at its end 52. The sides 54 and 58 of the transponder mount section 42 are shown as being solid, with longitudinally open-ended notches 68 and 70 respectively formed in the ends thereof forming the mount section open end 64. As will be seen, these notches fit over part of the key blank and laterally and longitudinally locate the holder in relation to the key blank when the holder is inserted into position on the key blank head.

The open-framed cage construction defining the transponder retention space in the transponder mount section 42 is formed by the spaced-apart mount section sides 54 and 58 and cross pieces 72, 74, 76, 78 and 80 joining the sides 54 and 58. The two cross pieces 72 and 74 join the lateral edges 82 and 84 of sides 54 and 58 and form one ladder-like open side 56 of the mount section 42, and the other cross pieces 76, 78 and 80 join the opposite lateral edges 86 and 88 of sides 54 and 58 and form the other ladder-like open side 60 of the mount section 42. These cross pieces extend laterally of the transponder mount section 42 and are spaced longitudinally of that section between the section ends 52 and 64. It is to be understood that more than two cross pieces may be used on either or both sides 56 and 60, and that the number of cross pieces on side 56 of the mount section 42 may be or may not be identical in number to those on the side 60 of the mount section 42. In the construction shown, there are fewer cross pieces forming open side 56 than there are forming open side 60 and none of them are laterally aligned in the same cross plane.

The transponder holder mount section 42 and the transponder 34 are so sized relative to each other that the transponder 34 fits tightly within the mount section 42, passing through the mount section end opening 62 so that one transponder end 98 engages the closed end 66 of the mount section. The cross pieces 72, 74, 76, 78 and 80 provide laterally yieldable mount section sides 56 and 60. They are slightly flexible yet stiff so that can be bent slightly outward by the cylindrical body of the transponder 34 as the transponder is inserted if the spaces between sides 56 and 60 are very slightly less than the diameter of the transponder cylindrical body. Such bending slightly shortens the space between the mount section solid sides 54 and 58, either causing or increasing the gripping force acting on the transponder 34 that is present when the transponder is inserted into the mount section. This provides a tight yet resilient fit that is sufficient to hold the transponder 34 in position in the transponder mount section 42 of holder 36 while the two, in assembled relation, are a subassembly which is thereafter assembled into the key blank head section 112. Of course, a sufficiently tight fit may be obtained by having the effective width and/or the height of the transponder-receiving space be equal to but no greater than, or only slightly less than, the diameter of the transponder cylindrical body.

Both of the legs 44 and 46 of the key transponder holder 36 are constructed in the same manner, and therefore the reference numerals identifying various parts thereof are the same. Leg 44 will be described in detail, and the same description and reference numbers where used are understood to equally apply to leg 46.

Leg 44 includes sides 90 and 92 respectively located in the planes of the sides 56 and 60 formed by the cross pieces 72, 74 and the cross pieces 76, 78 and 80. The leg sides 90 and 92 are joined by a bottom 94 which on one end is effectively an extension of the reversely-bent spring section 48 for leg 44 and 50 for leg 46. Bottom 94 is laterally spaced from the transponder mount section 42, allowing the legs 44 and 46 to bend toward as well as away from the transponder mount section side 54 in a cantilever manner during installation of the transponder 34 and the transponder holder 36 in the key blank 32 as a subassembly (later described), the bending taking place in the spring sections 48 and 50. A notch 96, of generally trapezoidal shape when viewed in elevation, is formed in leg 44 so that the leg sides 90 and 92 have the trapezoidal shape of the notch and the leg bottom 94 has the notch opening therethrough, effectively dividing the bottom 94 into two parts and causing the outer end 98 of the leg to be hook-shaped as seen in side elevation.

The leg bottom 94 does not extend to the outer edges 100 and 102 of the leg sides 90 and 92. Thus, the bottom 94 and the sides 90 and 92 define an open channel 104 extending throughout the length of the leg 44. Channel 104 is open-ended and has its open longitudinally-extending side opening away from the transponder mount section 42. The end of each bottom 94 opposite its spring section 48 or 50 is beveled as shown at 106 so that the end opening of channel 104 is inwardly enlarged and the beveled surfaces at 106 can act as cam surfaces as will be later described.

The transponder 34, once mounted in the mount section 42, is resiliently mounted relative to the key blank 32 because of the cantilever spring sections 48 and 50 which resiliently support the mount section and the transponder on the key blank head section legs 114 and 116 until the head cover 38 is molded about them and solidifies about them. Therefore, this resilient mounting arrangement is active from the time that the transponder is installed in the mount section, through the time that the subassembly transponder and holder are inserted into the key blank head section, until the head cover is molded and solidified to anchor all of these parts in place.

The key blank 32, shown FIGS. 1–5, 13–16, 17*a,* 18*a,* 19 and 20, has a shank section 110 and a head section 112. The shank section may be of any suitable key configuration for mechanically locking and unlocking a typical lock using a key. Thus, it may have various longitudinal grooves as well as edge notches of various shapes, sizes and depths which cooperate with various mechanical parts of a lock to open it mechanically. This well-known arrangement forms no part of the invention herein disclosed, and therefore is not further described. The head section 112 is generally U-shaped, and has a pair of legs 114 and 116 which have their outer portions positioned parallel to each other. Legs 114 and 116 are of a thickness such that they fit snugly but in sliding relation into the channels 104 of the legs 44 and 46 of transponder holder 36 as will be further described.

It is preferable that the key blank head section legs 114 and 116 respectively have their inner edges 120 and 122 provided with protrusions 124 and 126, each protrusion extending inwardly of the U-shaped head section 112 toward the key blank axis 127. Axis 127 extends longitudinally of the key blank. These protrusions are also preferably of either a trapezoidal shape complementary to the trapezoidal shape of the notches 68 and 70, or have their edges being arcs of a circle whose radius is such that there are two points of engagement with the angled sides of the trapezoidal notches 68 and 70 into which they extend when the assembly of the mount section with its transponder is accomplished.

The transponder-and-holder subassembly, formed by the transponder 34 and the holder 36 with the transponder received within the holder mount section as above described, is inserted into the open end of the head section 112 with the channels 104 receiving the inner edges and longitudinally adjacent portions of the legs 44 and 46. As the holder is moved into the U-shaped opening, the beveled ends 106 of the channel bottoms 94 engage the complementary angled surfaces provided by the complementary trapezoidally shaped protrusions 124 and 126, camming the holder legs 44 and 46 inwardly in cantilever fashion toward the transponder mount section 42 until the protrusions 124 and 126 fit into their mating notches 96, at which time the holder legs 44 and 46 spring outwardly in cantilever fashion so that the arcuate or beveled sides of the protrusions 124 and 126 and the angled sides of the notches 96 are in mating engagement, precisely locating the subassembly of the holder 36 and the transponder 34 longitudinally in the key head section 112.

While the protrusions 124 and 126 are not absolutely necessary, they are very desirable because, in cooperation with the notches 96 of the transponder holder legs 44 and 46 and in concert with the notches 68 and 70 of the transponder mount section 42, they provide a more precise and secure installation of the transponder and transponder holder subassembly as the key assembly is being assembled. When the protrusions are omitted, the precise longitudinal location of the holder within the key head section would be determined only by other means such as a precise abutment provided on the key blank head section which is engaged by the bottoms of notches 68 and 70 or leg ends 98. If the leg end 98 are so utilized, they would then need to have flat end surfaces instead of end surfaces which are curved in the manner shown. Also, the fitting of the legs 44 and 46 in the channels 104 would then have to be more precise to assure a tight fitting retention after the transponder-holder subassembly is in place in the key head section so that the subassembly remains in its proper position until the head cover is molded in place and hardened.

FIGS. 17*a* through 20 illustrate the assembly process of the key assemblies of FIGS. 1 through 16. In FIGS. 17*a,* 17*b* and 17*c,* three basic parts are illustrated in an exploded view arrangement. Each part is manufactured separately and may even be made at different locations. The key blank 32 need not have the notches cut in the key shank 110 until some later time after the entire key assembly is completed. Typically, the shank part of each key assembly would be made to fit a specific lock which senses and matches the code signals of the transponder 34 of the particular key assembly.

Figure 11:
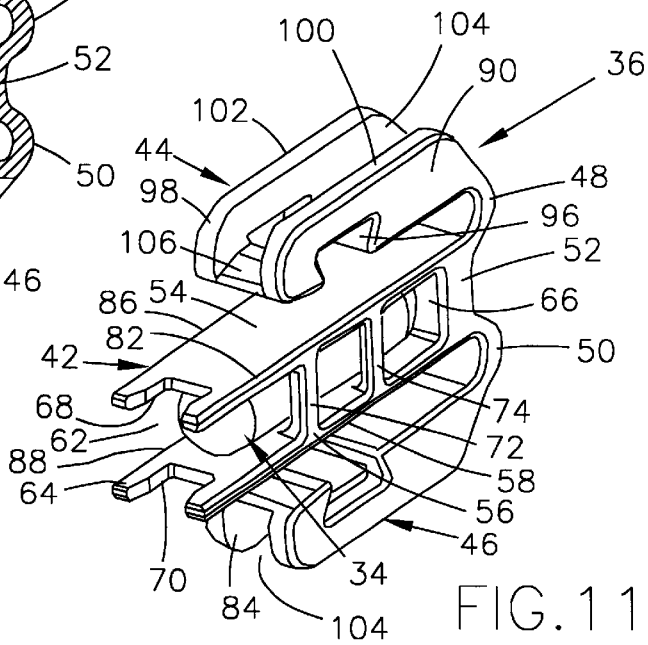
FIG. 11 is an isometric view of a subassembly of the transponder holder of FIGS. 6–10 and a transponder installed in the transponder holding portion of the transponder holder.
Figure 12:
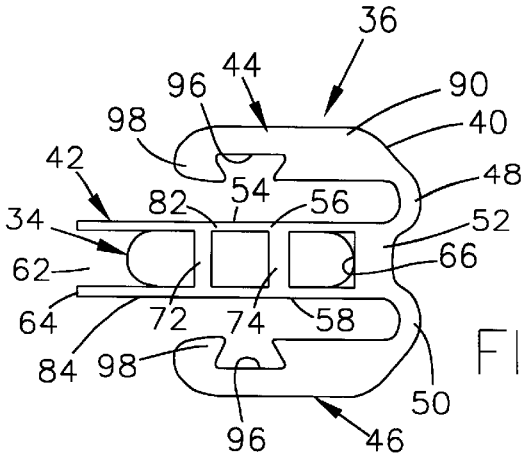
FIG. 12 is a side elevation view of the subassembly of FIG. 11.
Figure 13:
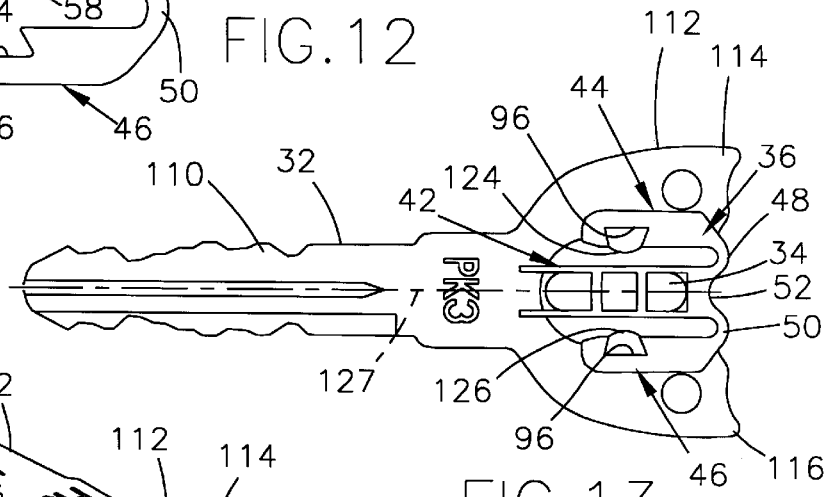
FIG. 13 is a side elevation view of another subassembly comprising the subassembly of FIGS. 11–12 and a key blank. The transponder and transponder holder subassembly is shown in its designated position in the key blank.
Figure 14:
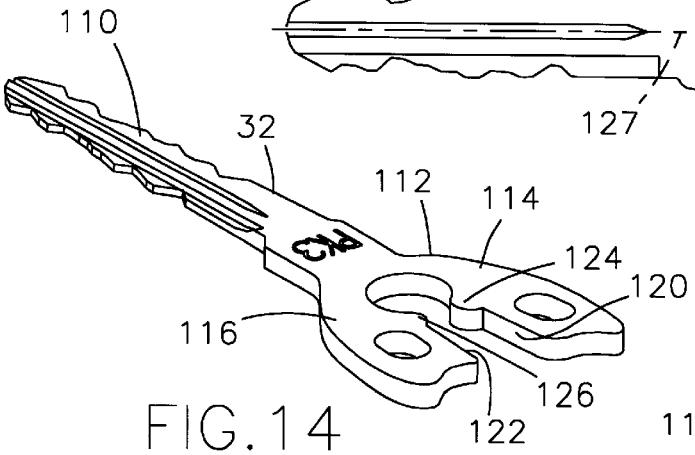
FIG. 14 is an isometric view of a key blank such as the one shown as part of the subassembly of FIG. 13.
Figure 15:
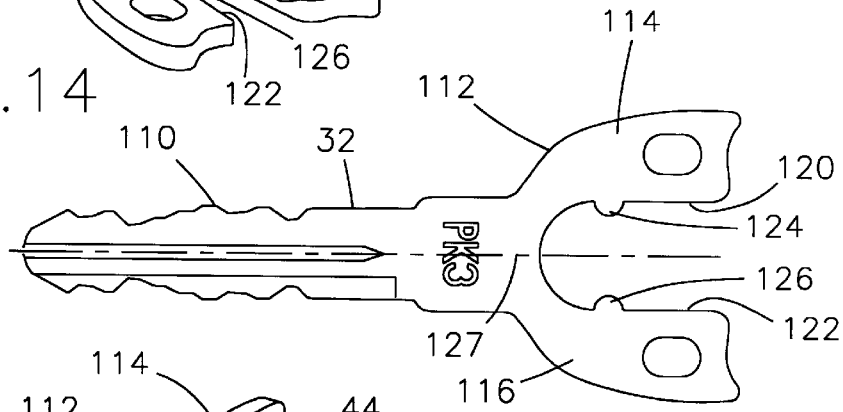
FIG. 15 is a side elevation view of the key blank of FIG. 14.
Figure 16:
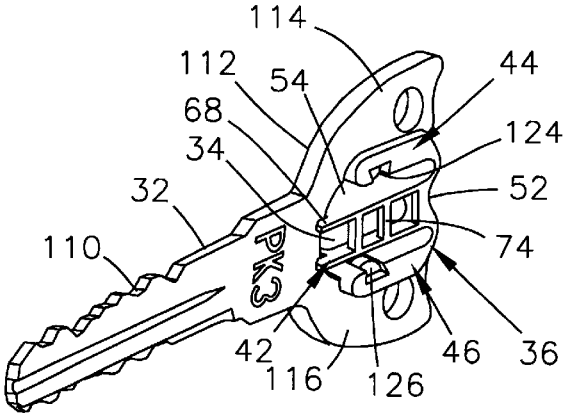
FIG. 16 is an isometric view of the subassembly shown in FIG. 13.
Figure 21:
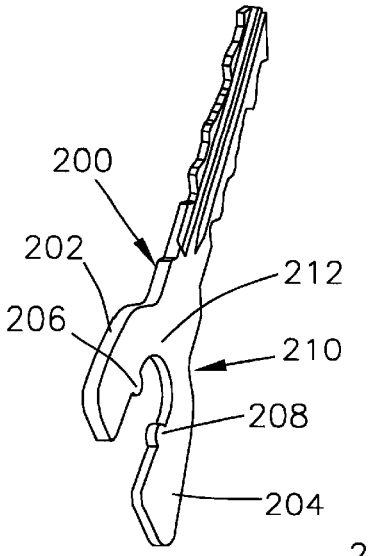
FIG. 21 an isometric view of a key blank of the type shown in FIGS. 17*a* and 18*a,* the making of this key blank being the first step in the manufacture of a modified key assembly shown in FIG. 25.

In FIGS. 18*a* and 18*b,* the transponder 34 has been inserted into the transponder holder 36 to form a subassembly shown in FIG. 18*b.* This is the same subassembly as is shown in FIGS. 11 and 12. Since the resilient ladder-like open sides 56 and 60 of the transponder grip the transponder and retain it in the holder, these subassemblies may be transported, stored, and made available for assembly into the key blanks as needed. A separate retainer plug is not required.

FIG. 19 shows the completion of the next step in the assembly process, which is that of inserting the transponder-holder subassembly into the generally U-shaped opening formed by the legs 114 and 116 of the key blank 32. This is accomplished by slidably receiving the inner surfaces of legs 114 and 116 from which protrusions 124 and 126 extend in the channels 104 of each transponder holder leg 44 and 46 and sliding the transponder-holder subassembly into position. This position is attained by the fitting of the notches 68 and 70 to the key blank 32 and by a camming action of the bevel sections 106 of the channel bottoms 94 engaging the curved (any usually semi-circular) protrusions 124 and 126, forcing the legs 114 and 116 to resiliently bend at 48 and 50 in cantilever fashion toward the transponder mount section 42 as the bottoms 94 of the channels 104 pass the protrusions. When the openings in the channel bottoms formed by notch 96 reach the protrusions 124 and 126, the legs spring back as the protrusions extend into the notch openings in the channel bottoms. Because the location of the notch openings longitudinally of the transponder holder are precisely located in the molding process by which the transponder holders are formed, each of the protrusions 124, 126 engages both edges of the opening with which it is engaged, precisely locating the transponder-holder subassembly in the key blank 32 and retaining the subassembly in its desired position so that the transponder 34 can later be sensed and its code identified by appropriate sensing and code identification equipment. Thus the subassembly consisting of the key blank 32, the transponder 34 and the transponder holder 36 has been formed in this process step.

Figure 2:
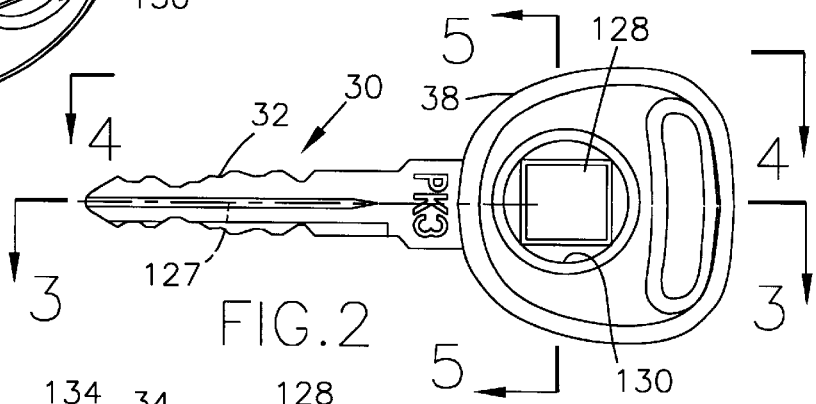
FIG. 2 is a side elevation view of the key assembly of FIG. 1.
Figure 3:
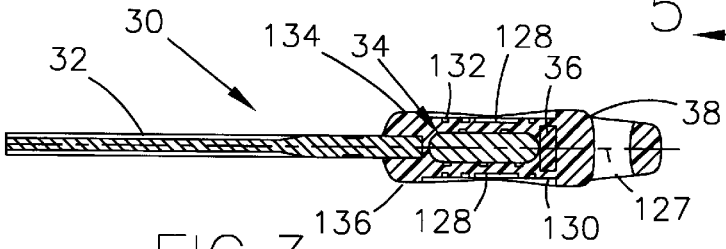
FIG. 3 is a cross section view of the key assembly shown in FIG. 2, taken in the direction of arrows 3—3 of that Figure.
Figure 4:
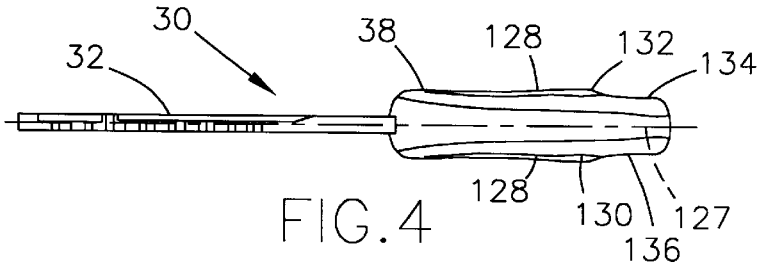
FIG. 4 is a cross section view of the key assembly shown in FIG. 2, taken in the direction of arrows 4—4 of that Figure.
Figure 5:
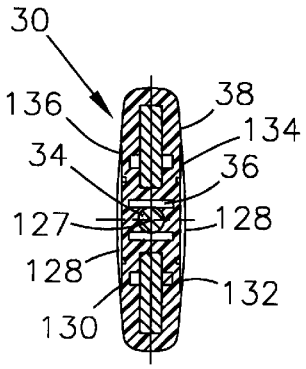
FIG. 5 is a cross section view of the key assembly shown in FIG. 2, taken in the direction of arrows 5—5 of that Figure.
Figure 6:
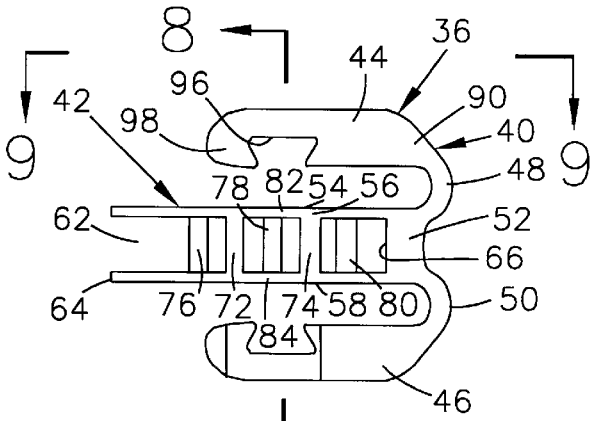
FIG. 6 is a side elevation view of the transponder holder which is a part of the key assembly of FIGS. 1–5.
Figure 7:
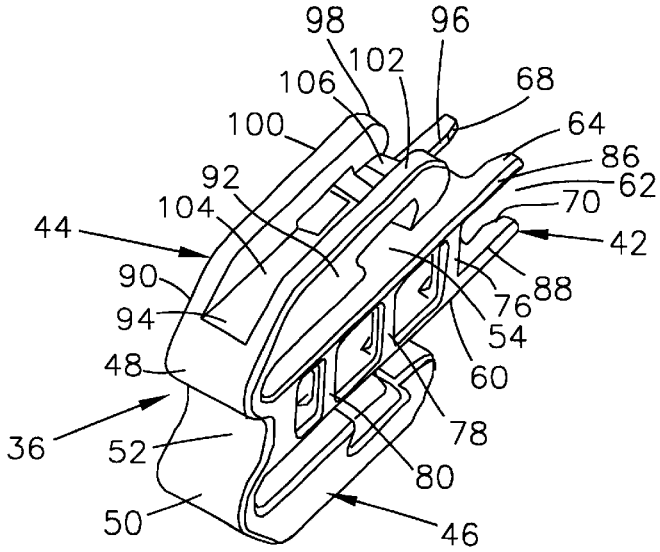
FIG. 7 is an isometric view of the transponder holder of FIG. 6.
Figure 8:
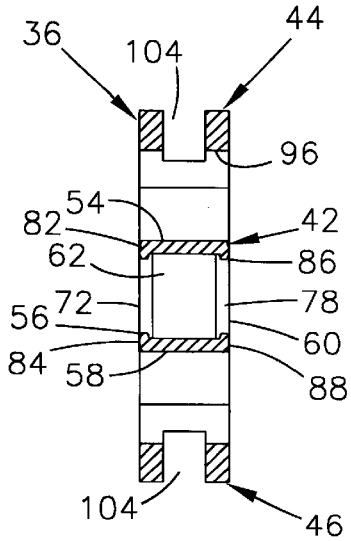
FIG. 8 is a cross section view of the transponder holder illustrated in FIG. 6, taken in the direction of arrows 8—8 of that Figure.
Figure 9:
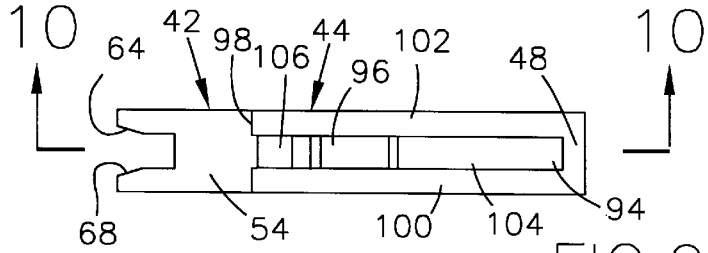
FIG. 9 is an elevation view of the transponder holder shown in FIG. 6, taken in the direction of arrows 9—9 of that Figure.
Figure 10:
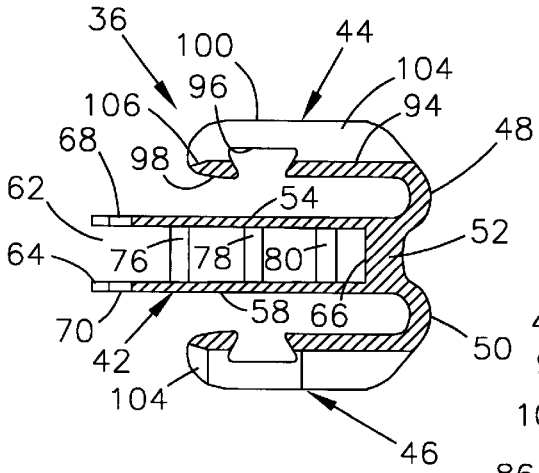
FIG. 10 is a cross section view of the transponder holder shown in FIG. 6, taken in the direction of arrows 10—10 of that Figure.

The head section of the subassembly just made is then placed in a mold and suitable plastic is molded about it to form the key head cover 38. In this molding operation, the plastic fills the voids about the transponder, the transponder holder and the key blank portions covered by the cover. The filled voids are illustrated in FIGS. 3 and 5. The plastic forming the key head cover 38 hardens in place so that in effect the transponder and its holder are potted in place so as to be completely sealed against deleterious outside influences. The virtual integration of the key head section, the transponder holder and the transponder into the head cover as a solidified unit effectively prevents disassembly and reassembly of the transponder and its holder without destruction of one or both of them. Thus this process step results in the finished key assembly 30 shown in FIG. 20 as well as in FIGS. 1–5.

A logo disc or wafer 128 have the logo design printed on the disc or wafer or a thin sheet of suitable material. The logo may be used to identify a particular make or model of a vehicle. The logo disc or wafer or thin sheet of suitable material 128 on which the logo design is provided may be molded or later secured in place in the depressions 130 and 132 formed in the side surfaces 134 and 136 of the key head cover. FIGS. 1 and 2 illustrate such a logo design in the form of a square. This can be done concurrently with the molding which forms the key head cover 38. Alternatively, the disc or wafer containing the logo design may be secured in place after the key assembly is formed as it appears in FIG. 20 by an appropriate adhesive.

Figure 25:
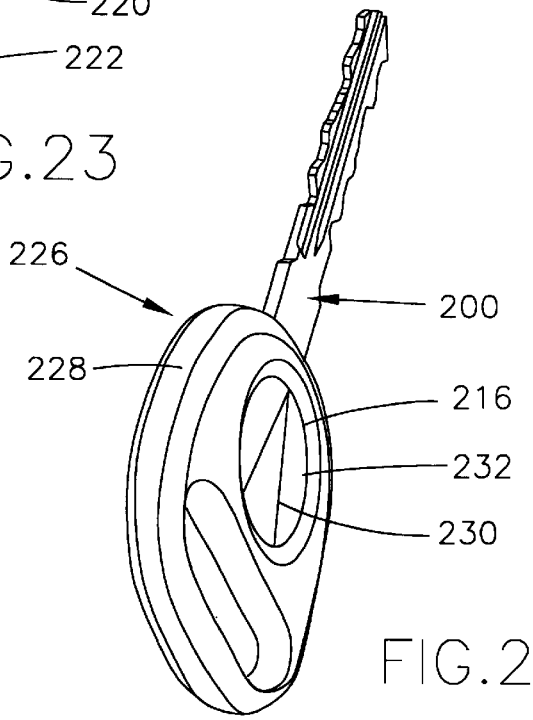
FIG. 25 is an isometric view of a modified key assembly manufactured and assembled as shown in FIGS. 21 through 24 and then having the key head cover molded in place over the transponder and the transponder plug, and over either part or all of the transponder holder.

The logo design shown in FIGS. 22, 23, 24 and 25 may be molded in place using a disc or wafer containing the logo design. Alternatively, the logo as shown in FIG. 25 may be a design on a disc or wafer or other suitable material which is later secured in place in the recess formed in the key head cover as discussed above with regard to FIG. 20.

The key head section cover 38, shown as a part of the completed key assembly 30 in FIGS. 1–5 and 20, is preferably made of a plastic selected from the group consisting of polypropylene, polyvinylchloride (PVC) such as plastized PVC, PC, ABS, SANTOPRENE™ compounds, and alloys and compounds thereof, among others. The selected plastic should be of a suitable color and cosmetic appearance with a surface having a pleasing tactile feel. Normally, the key head is molded over the assembled transponder-holder-key blank head section at a pressure up to about 350 bar and a temperature up to about 410° F., or less, depending upon the characteristics of the molding plastic being used. The molding equipment may comprise a 40 ton vertical molding machine such as JSW Model No. JTREII-55V. As seen in FIGS. 3 and 5, the material from which the key head cover is molded also fills any voids the transponder holder and the key blank legs, as well as around the transponder itself. It therefore forms a unitary mass when hardened which includes the transponder, the transponder holder, the key blank legs and part of the center portion of the key blank to which the legs are attached, as well as the key head cover itself.

While any suitable transponder can be utilized, desirable results have been achieved by employing one or more transponders supplied by Sokymat of Switzerland. Examples of such transponders have been used by General Motors Corporation, for example, and are identified by General Motors as DELCO part numbers 16231237 and 16232459.

While the transponder holder 36 can be molded from any suitable material, desirable results have been achieved by using an alloy comprising polycarbonate (PC) and acrylonitrile butadiend styrene (ABS). When the plug 222 of FIG. 23 is used, it is preferably made of the same material as that used to make the transponder holder.

Figure 22:
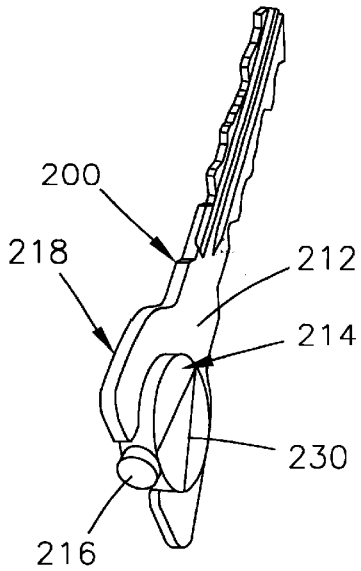
FIG. 22 is an isometric view of the results of the second step in the manufacture and assembly of a modified key assembly shown in FIG. 25. The transponder holder has been made by molding it in place on the appropriate parts of the key blank of FIG. 21.
Figure 23:
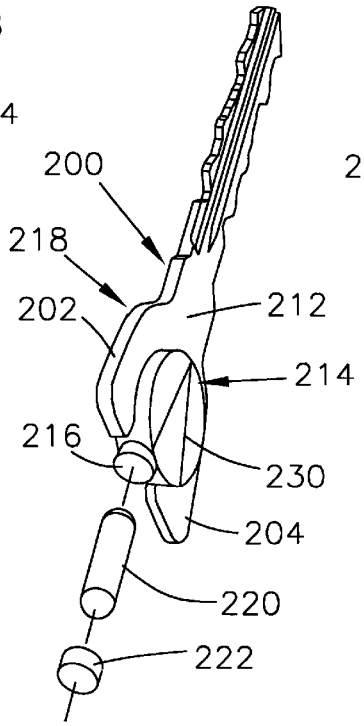
FIG. 23 is similar to FIG. 22, and is shown to illustrate the third step in the manufacture and assembly of the modified key assembly shown FIG. 25.
Figure 24:
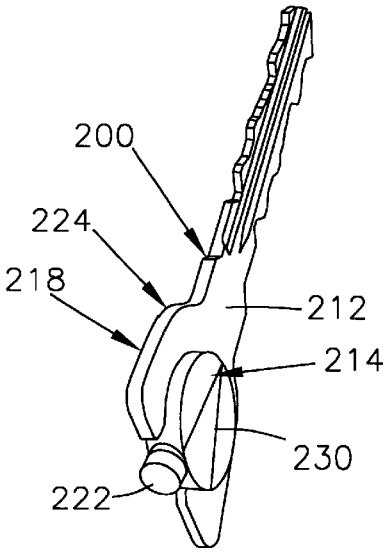

Referring now to the construction and process of making the key assembly as shown in FIGS. 20–25, a similar key blank 200 is made in step 1 with legs 202 and 204 having protrusions 206 and 208, all similar to comparable elements of key blank 32 shown in various ones of FIGS. 1–20. In step 2, the head section 210 of the key blank, including legs 202 and 204 and the part 212 of the key blank joining these legs, is placed in an appropriate molding machine, and the transponder holder 214 is molded in place, as shown in FIG. 22. This forms the subassembly 218 shown in FIG. 22. Holder 214 is molded with a recess 216 for receiving the transponder 220 and the plug 222, as shown in FIGS. 23 illustrating the next step of making the subassembly 224 of FIG. 24. Subassembly 224 includes the subassembly 218, the transponder 220 and the plug 222. It is made by inserting the transponder 220 into the recess 216 and closing the recess open end by inserting plug 222. The plug retains the transponder 220 in the recess 216 while this subassembly 224 is transported or stored.

The head end of the subassembly 224, which is the transponder holder 214, the transponder 220, the plug 222 and the key head section 210, are placed in a suitable molding machine such as earlier identified, and the key head cover 228 is molded as shown in FIG. 25, resulting in the completed key assembly 226.

In a preferred step in this process, the logo 230 is molded on one or both sides of the transponder holder 214 concurrently with the molding of the holder 214. Then, the key head cover 228 may be molded with an opening 232 around each logo 230 so that the logo is visible. It is also within the purview of the invention that the key head cover 228 may be of material which is sufficiently transparent at least in the portion over the logo 230 to cover the logo and yet keep the logo visible through that part of the head cover 228.

It is to be understood that the transponder acts, with the key inserted properly in the lock, to have a precoded identification signal recognized by sensing and comparison apparatus in or associated with the lock. If the signal is the proper signal to permit the lock to be unlocked, the apparatus acts to permit that to occur. If it is not the proper signal, it will not so act. In some instances, it may also activate an alarm. It may also either activate such controls as other disabling apparatus further disabling the automobile engine from being started, disabling the automobile steering mechanism, and/or locking the vehicle brakes, all toward preventing the automobile to be driven or moved without authorization. This may also include lack of action to release any such disabling apparatus which is normally in the disabled mode when no authorized key is in use, therefore keeping such apparatus in the disabled condition. It may activate remote sensor and monitoring systems by radio when such systems, already in use on many vehicles, have been installed in the vehicle. In any case, access to the vehicle under control of the lock is denied.

I claim:

1. A key assembly for a lock comprising:

a key blank having a longitudinal axis on which is located a key blank center section, one key blank end extending from said center section in one axial direction and being adapted to be shaped to fit and operate a lock, and another key blank end extending from said center section in the other axial direction, said another key blank end including legs extending from said center section in laterally spaced relation to each other to form an open-ended recess;

a transponder mounted in said open-ended recess in a precisely-defined axial and lateral location relative to said key blank;

a molded transponder holder molded of a plastic to a defined shape and having a recess in which said transponder is received and retained, said transponder holder being secured to said legs;

and a key head cover molded of a suitable plastic in place about said key blank another end and said transponder and said transponder holder;

said transponder, and the plastic from which said transponder holder is molded and hardened, being able to withstand without deformation a molding pressure up to 350 bar and a molding temperature up to 410° F. impressed thereon during the molding of said key head cover;

said molded transponder holder having a transponder mounting section resiliently supporting and retaining said transponder until said key head cover has been molded in place, and legs resiliently connected with said transponder mounting section, said transponder holder legs having channels on the outer sides thereof receiving said key blank legs, said channels each having sides joined by a bottom provided with an opening extending toward said transponder mounting section, said key blank legs each having a protrusion extending toward said transponder holder mounting section and snap-fitted into one of said channel bottom openings, said protrusions and said channel bottom openings and said channel sides cooperating to define the precise axial and lateral location of said transponder holder and said transponder in relation to said key blank.

2. A key for a lock, said key comprising:

a key blank having a shank section and a head section, said head section having a pair of substantially parallel spaced-apart legs defining the sides of a generally U-shaped opening, each of said legs having a protrusion extending laterally into the U-shaped opening located in a precise longitudinal position on its leg;

a transponder mounted between said key blank legs and;

a transponder holder having a transponder mount section resiliently receiving and gripping said transponder, and further having legs resiliently connected to said mount section and extending substantially parallel to but laterally spaced from said mount section;

said transponder holder legs each formed as an open channel with the open side thereof opening away from said mount section, and providing a bottom for the open channel which is adjacent to but laterally spaced from said mount section, said bottom having an opening receiving a part of said protrusion of an associated one of said key blank legs with the longitudinally spaced sides of said protrusion engaging the longitudinally spaced sides of said opening in said bottom, providing a snap-fit retention and precise location of said transponder and said transponder holder within the U-shaped opening defined in part by said key blank legs;

and a key head cover molded over said key blank legs and said transponder holder and said transponder and filling the voids in said transponder holder and between said key blank legs, said cover when solidified sealing and protecting said transponder and further assuring that said transponder remains in its precise location relative to said key blank legs.

3. A key assembly of claim 1 made and assembled by the following method of making and assembling a key assembly comprising the steps of:

(a) providing a transponder;

(b) molding said transponder holder providing said mounting section for a transponder;

(c) forming a subassembly composed of the transponder, the transponder holder and the key blank and retaining the transponder in a precise location in the transponder holder and in the key blank while the subassembly may be stored and transported; and (d) placing the subassembly in a molding machine and molding a key head cover about key blank one end and the transponder holder and the transponder while concurrently filling in any voids located in the U-shaped recess with the material from which the key head cover is being molded, forming the completed key assembly;

said transponder holder having opposite sides and a logo molded intregally thereon during the molding step of making said transponder holder.

4. A key assembly of claim 3, said key head cover having side openings corresponding with said logos having been molded on said transponder holder so that said logos are visible through said key head cover openings.

5. A key assembly of claim 3, said key head cover having sufficiently transparent side surfaces corresponding with said logos molded on said transponder holder so that said logos are visible through said key head cover side surfaces.

* * * * *